United States Patent [19]

Huddle

[11] 3,990,194

[45] Nov. 9, 1976

[54] ARCH SUPPORTED MEMBRANE STRUCTURE AND A METHOD OF ERECTION THAT PRETENSIONS THE ARCHES AND MEMBRANES

[75] Inventor: Carl F. Huddle, Pleasant Ridge, Mich.

[73] Assignees: Tension Structures Co., Pleasant Ridge; Jon Vredevoogd, Mason, both of Mich. ; part interest to each

[22] Filed: Feb. 13, 1975

[21] Appl. No.: 549,711

Related U.S. Application Data

[62] Division of Ser. No. 434,077, Feb. 19, 1974, which is a division of Ser. No. 359,892, May 14, 1973, Pat. No. 3,909,993.

[52] U.S. Cl. ..... 52/80; 52/747

[51] Int. Cl.[2] ..... E04B 1/32; E04G 21/00

[58] Field of Search ..... 52/63, 80, 82, 86, 87, 52/88, 222, 223, 747; 135/1 R, 4 R

[56] References Cited

UNITED STATES PATENTS

| | | | |
|---|---|---|---|
| 3,057,119 | 10/1962 | Kessler | 52/63 |
| 3,094,812 | 6/1963 | Peeler et al. | 52/80 |
| 3,765,134 | 10/1973 | Gilchrist | 52/80 X |

*Primary Examiner*—J. Karl Bell

[57] ABSTRACT

A pre-stressed arch supported membrane structure, a method of assembly and erection and a means of tensioning a membrane of double curvature supported by and attached to upright arches.

By moving the ends of flat resilent arch structural members closer together, pre-stressed arches are formed by "bowing."

Assembly and erection consists of attaching flat arch member ends to base beams, one fixed and one movable; attaching membranes to these flat members when reclined on the ground, operatively attaching transverse or inclined arch members to their respective structural members; moving the non-fixed base beam towards the fixed base beam thus causing the arches to be formed as the structure rises to its erected position. Preliminary tensioning of the membrane can take place when the transverse or inclined arches are attached to the arch members in their reclined position. Final membrane tensioning adjustments at the crown and at the base by moving the arches horizontally then anchoring the structure to the base, safely securing the base beams and arch ends completes the erection of the main structure.

An alternate method of erection is provided by elimination of the base beams by fastening the arches directly to the base. The support arches are "bowed" after being attached to the transverse or inclined arches and then attached to the base by means of an adjustable fastener.

Lightweight end closures or doors may be assembled and partially attached before erection to eliminate or decrease above ground assembly.

11 Claims, 14 Drawing Figures

ARCH SUPPORTED MEMBRANE STRUCTURE AND A METHOD OF ERECTION THAT PRETENSIONS THE ARCHES AND MEMBRANES

This is a division of application Ser. No. 434,077 filed Feb. 19, 1974 which in turn is a division of Ser. No. 359,892 now U.S. Pat. No. 3,909,993 filed May 14, 1973 for an arch supported membrane structure.

BACKGROUND OF INVENTION

This structure is a combination of my patented inclined and vertical arch structure but includes a new method of tensioning the membranes between the arches and a new method of erection by which very large structures can be assembled on the ground or base, then erected and adjustments made to properly tension the membranes.

A double arch section in the structure can be used, similar to the construction in my patent application, SN49811, June 25, 1970, for a *Pavilion With Intermediate Arch*, to provide an area to mount ventilation or other equipment and to also provide additional structural strength to support overhead cranes, winches or other such tools for aircraft or other maintenance.

These large shelters should have dependable, continuous membrane fastener means for quick efficient assembly on the ground and to prevent point stresses in the membranes as described in another of my recent patent applications.

SUMMARY OF INVENTION

The principal object of this invention is to provide large arch supported, highly tensioned double curvature membrane structures that have clear spans with open ends, closed ends, or full opening doors and are economical in cost and occupy a minimum of space in addition to their sheltered area.

The second object of this invention is to provide curved arch membrane supports that can be formed by "bowing," at the erection site, from straight or flat structural members that are sufficiently resilent to be bent to the arch shape desired and still have the structural rigidity necessary to construct a dependable, rugged structure that can safely withstand adverse weather conditions and reasonable shock loads, if necessary.

Another object of this invention is to provide a method to erect tensioned membrane structures by assembling the structural flat arch members, used to form arches, to their base beams, attaching the tailored membranes to these flat structural members, fastening the membrane tensioning members to their respective structural members, attaching the end closures, if any, and then erecting the shelter by drawing the base beams toward each other to form the structural curved arches.

Another object of this invention is to provide a method of tensioning the membrane between the support arches by using inclined arches to force the support arches apart in their crown area.

Still another object of this invention is to provide a method of tensioning the membrane(s) between the support arches by using fairly flat transverse arches between two, or by spaning a multiplicity of, support arches, to force apart the membrane support arches.

A further object of this invention is to provide small and large lightweight shelters that can be moved in their erected state, weather conditions being favorable, or can be dismantled by reversing the erection procedure and reassembled in another location.

Another object of this invention is to provide a closer spaced, multiple arch section in the structure to support equipment above and below the roof.

A still further object of this invention is to provide a structural end arch frame for the shelter to which a full opening door can be attached and folded within the shelter.

It is desired to point out that due to the application of these structures from very small to very large shelters the illustrations above do not show all the combinations of arch arrangements that can result from this basic idea. As an example, support arches can be placed closer together or wider apart. Inclined arches can have different inclinations and can be located inside as well as outside of the structure. The same goes for transverse arches. The base beams can be omitted in some structures as the support arches can be attached directly to a base and each support and inclined arch can be individually "bowed" to the desired shape. All arches can also have cross-ties to alter their shape for appearance or for better structural support.

DESCRIPTION OF THE PREFERRED EMBODIMENTS

Figure 1:
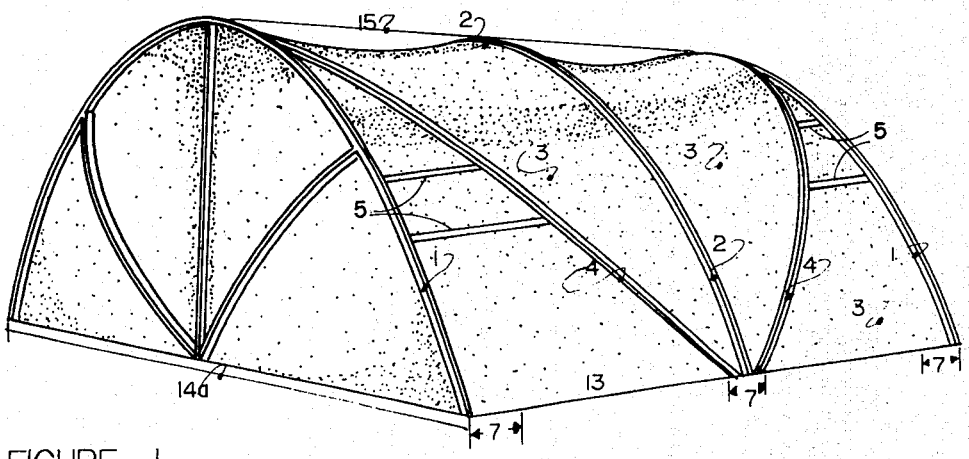
FIG. 1 is a perspective view of a structure using inclined arches to tension the membranes between the arches.

In FIG. 1 the shelter illustrated has vertical end arches 1 and one intermediate center arch 2. In between these arches are membranes 3 having a double curvature that are attached to and supported by the vertical arches 1 & 2.

The inclined arches 4 are used to force apart the end arches 2 above the base by compression members 5. The membranes 3 can be operatively attached to the inclined arches 4 to form a truss effect between the end arch 1 and the inclined arch 4, the compression members 5, and the tensioned membrane 6. All arches are adjustable horizontally 7 on their bases to properly tension the membranes near the base.

In some cases, it may be best not to attach the membrane 3 to the inclined arch 4. This depends upon weather conditions, size of the structure, etc. In such cases, the inclined arch 4 may have a non-uniform cross-section to resist bending in critical areas.

Inclined arches 4 attached to the crowns of the exterior support arches 1 and adjustably attached to the base can force the support arches apart by moving the feet of the inclined arch 4 toward the support arch 1. The latter support arch 1 can be moved to tension the lower part of the membrane and align the structure.

Figure 2:
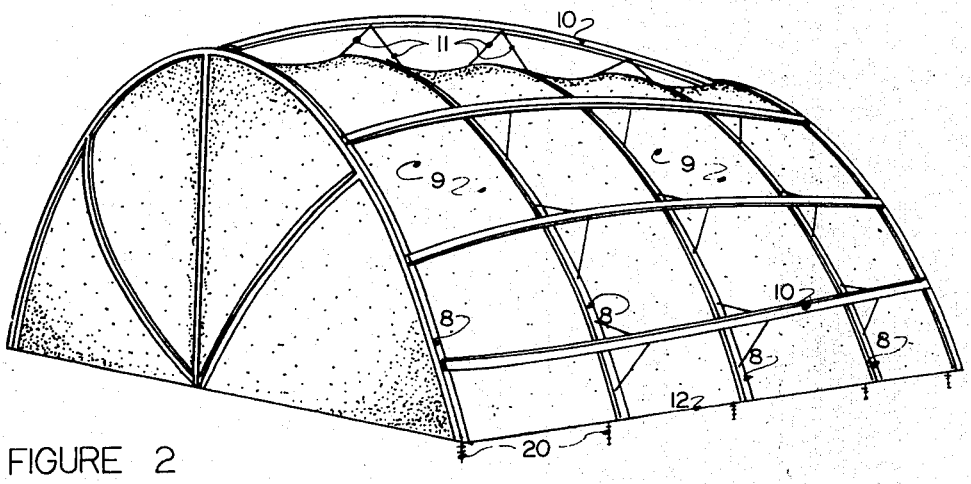
FIG. 2 is a perspective view of a structure using transverse arches around and above the structure to tension the membranes between the arches.

In FIG. 2 the shelter is supported by a series of vertical curved arches 8 that support a membrane 9 which is attached to the arches 8 that are forced apart by the transverse arches 10. The transverse arches 10 are stabilized between the exterior arches by members 11 which can be shortened to increase the tension in the membranes 9 between the arches 8. All the arches can be adjustably attached to the base 13 to properly tension the membranes between the arches 8 along the base and to align the shelter.

This is a method similar to the use of inclined arches except that a series of transverse arches can be used to tension the membrane 9. The stabilizing members 11 are adjustable and can be resilent. The transverse arches are also adjustable in length.

Figure 3:
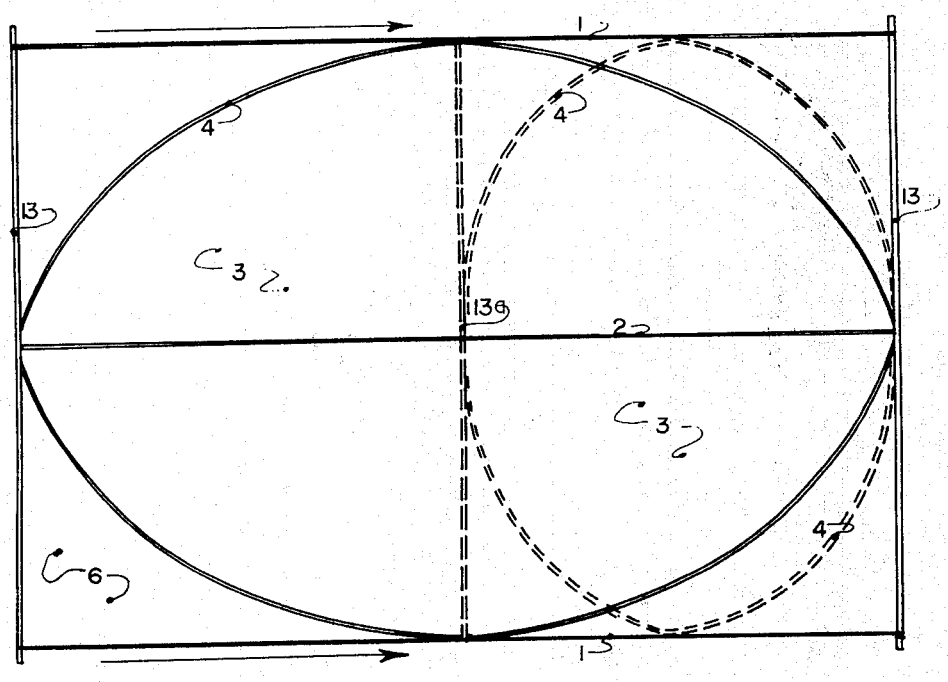
FIGS. 3, 4 and 5 illustrates the erection procedure for a structure having its membranes tensioned by an inclined arch.

In FIG. 3 a plan view of the shelter with inclined arches is shown before erection. Here all the arch members 1, 2 & 4 are laid flat on the base (before bowing) to attach the vertical arch members 1 & 2 and the inclined arch members 4 to the base beams 13. These vertical arch members 1 are positioned closer together to permit easy attachment of membranes 3 & 6, in this position, before erection. The inclined arches 4 are curved on the flat base, in the same plane as the vertical arch members 1 & 2, attached to the apex of arch members 1 and the base beams 13.

Figure 4:
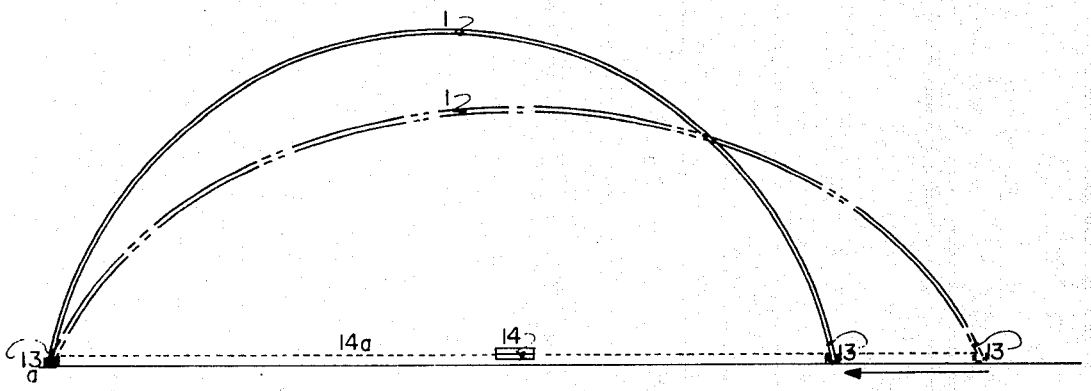

In FIG. 4 one base beam 13*a* is anchored in its final position before the "bowing" operation to erect the structure or the vertical arch members 1 & 2 can be individually "bowed" (fix one arch end to the base) after the assembly operation, if desired. The base beams 13 are then drawn closer together (FIG. 4) by winches 14 or other means.

For small shelters of this type, base beams 13 can be manually pulled together by brute force or pushed together by manpower, a vehicle, etc.

Figure 5:
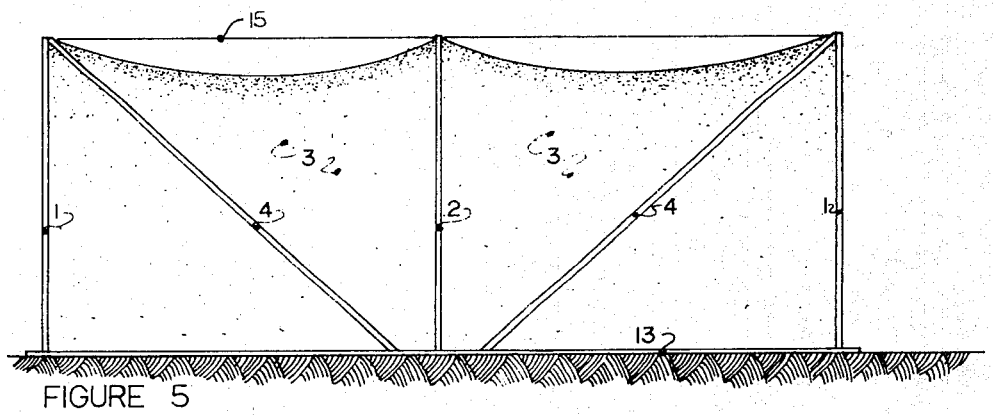

In shelters of all sizes, the vertical curved arches 1 & 2 and the inclined arches 4 are formed from the flat arch members to support and tension the membranes 3 respectively, by moving the base beams 13 to which the arches are attached closer together which causes the structure to rise. This operation is continued FIG. 5 until the shelter reaches its erected position. The final adjustments in alignment and tensioning of the membranes are then made by moving the arches horizontally in their attachment to the base beam. Anchoring of the structure is completed to be sure the shelter will not lift or blow away. Tie cables 14*a*, steel rods or other tension members can be used between the base beams 13 to make sure the arch ends do not separate under the constant pressure of the bent arch members. Safety cables 15 can also be used to prevent collapse of the structure in case of membrane 3 failure.

Figure 6:
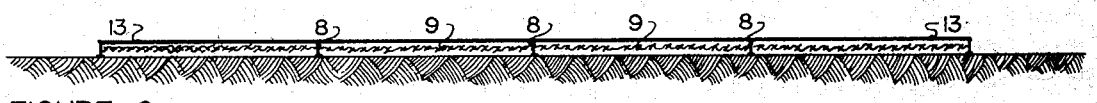
FIGS. 6, 7, 8, 9 and 10 illustrates the erection steps for a structure that has its membranes tensioned by overhead transverse arches.

In FIG. 6 the shelter in FIG. 2 is shown in its reclined assembly position. The base beams 13 are placed at the ends of the flat arch members 8 which are positioned for easy attachment of the membrane 9 and then attached to the base beams 13.

Figure 7:
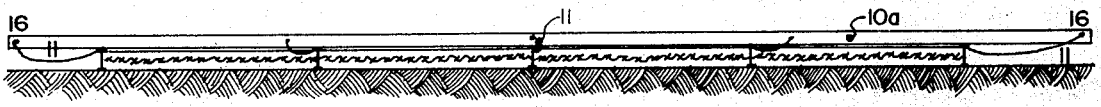
Figure 8:
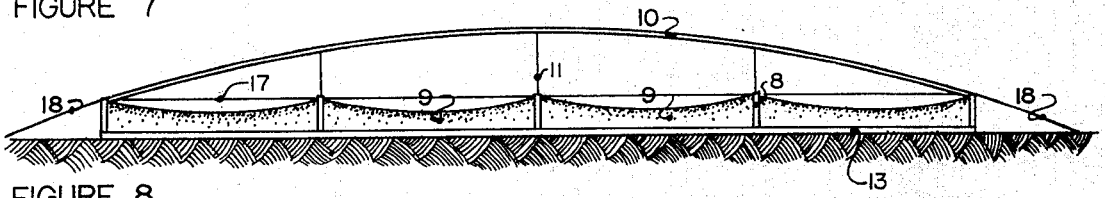

In FIG. 7, the membrane tensioning arch members 10*a* in their reclined flat shape are placed over the arches. The stabilizers 11 are connected to the members 10*a* but need not be at their final length. The ends 16 of transverse arch members are then moved closer to each other causing the flat member 10*a* to rise and form a rather flat arch 10, which is then attached to the exterior arches (FIG. 8) (or between each two arches if shorter rather flat arches are preferred.) This causes the membranes 9 to be tensioned to a selected value. In shelters where a long arch 10 is used between several arches 8, or between exterior arches, the tension in the membrane 9 can be adjusted by changing the length of the arch 10 and/or stabilizers 11 that attaches the arch 10 to the intermediate arches 8. Safety cables 17 can be installed between the vertical arches 8 to prevent collapse of the structure in case of membrane 9 failure.

Figure 9:
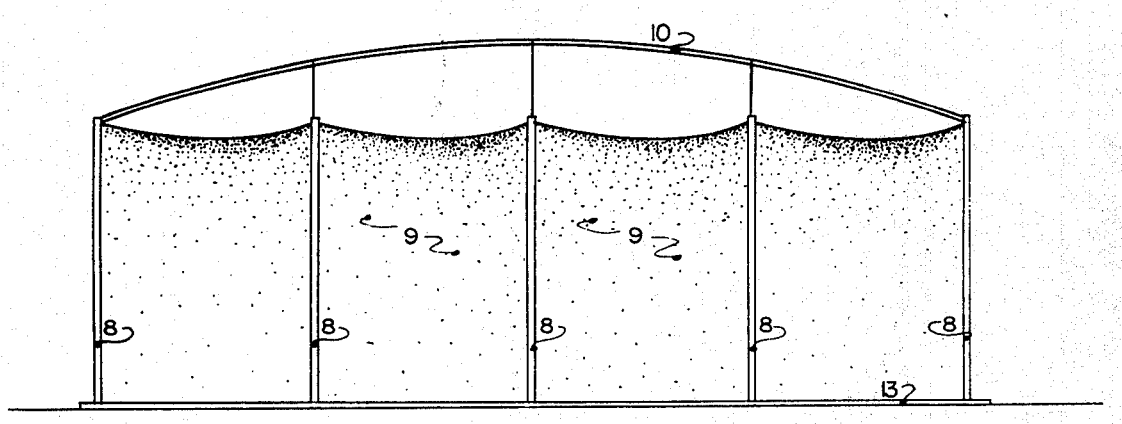
Figure 10:
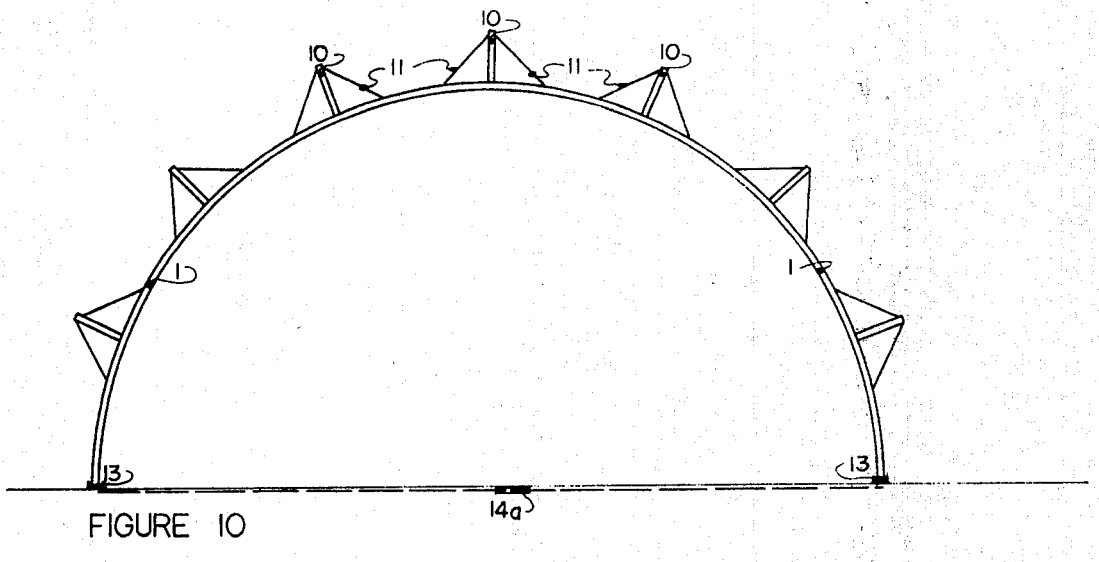

In the erection of this structure it seems best to provide guys 18 to guide the structure upward when the base beams 13 are drawn together by winches 14 or moved towards each other by any other method or force. As the structure rises sufficiently (FIG. 9) to put enough curvature in the arch members 8, the guys 18 can be disconnected as the shelter becomes more and more stable as it reaches its final position (FIG. 10).

The base ends of the arches 8 are then adjustable on the base beam 13 to properly tension the membranes 9 at the base 12. Some adjustments may be necessary to align the shelter to its design position.

Figure 11:
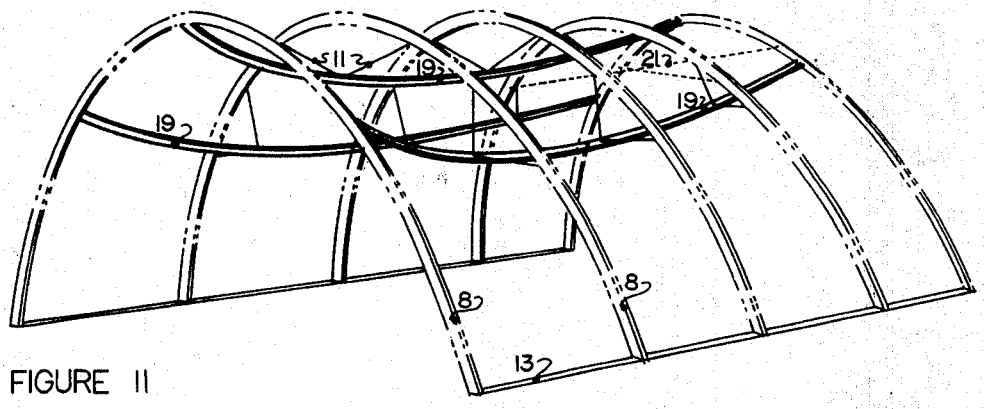
FIG. 11 is a perspective cutaway view of a shelter with overhead transverse arches under the roof of the structure that tensions the membranes between the arches.

In FIG. 11 the transverse arches 19 that tension the membrane 9 are shown inside the shelter and under the arches 8. This design offers a cleaner appearance for the exterior but some obstructions to the interior space. Crossing safety cables 21 between adjacent arches can be used on the interior but will again possibly interfere with interior occupancy. Safety cables from arch apex to arch apex in the interior will cause movement of the arches 8 with membrane failure as they must follow the membrane 9 sag line when installed.

Figure 12:
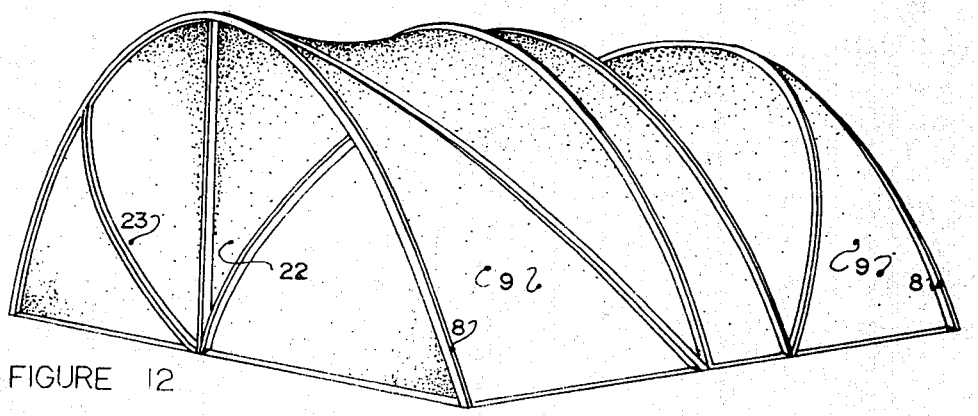
FIG. 12 is a perspective view of a structure having vertical and inclined arches with two vertical arches near the center of the structure to carry extra external or internal loads.

In FIG. 12 an end enclosure 22 has an uneven surface to obtain membrane curvature in more than one direction. When this is designed with convex curvatures 23 of more than 5% between outward points to inward points or valleys, and the membrane tensioned by pushing out on the exterior projections, the enclosure can withstand severe wind loads. These wind loads will be transferred to the arch frame of the shelter which is prevented from racking by the tensioned membrane 9 between the arches 8.

Figure 13:
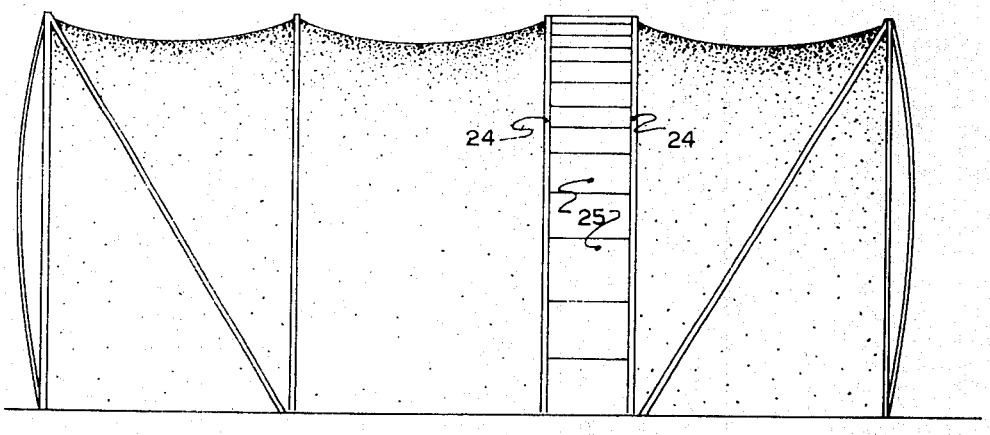
FIG. 13 is a side view of the above structure indicating that a multiple vertical arch section can be placed at other locations in the structure.
Figure 14:
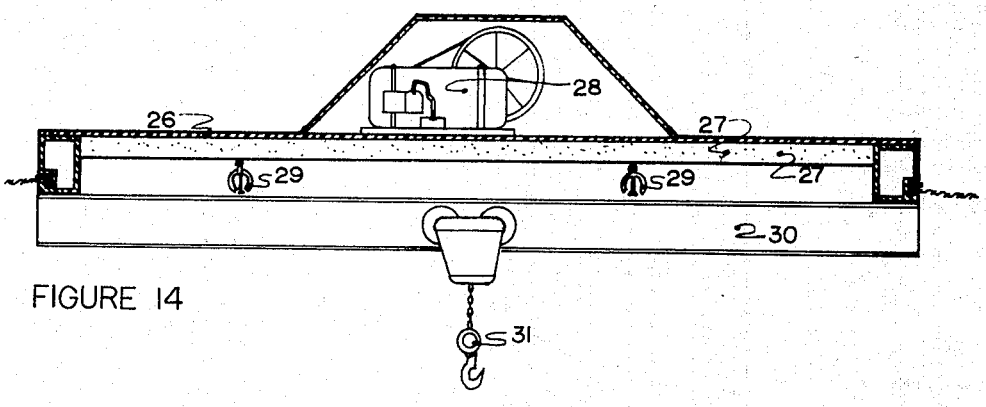
FIG. 14 illustrates the assembly of typical equipment such as cranes and hoists that can be supported by the multiple vertical equipment module.

In FIG. 13 a section of the structure is shown that has two closer spaced arches 24 to obtain greater structural strength to support utilities, ventilators, skylights, cranes, winches or other equipment. This multiple arch section may be located anywhere in the structure. More than one of these sections can also be used. When closely spaced arches 24 are used, the space between them 25 can be bridged or covered by fairly thin sheets of plywood, metal, composite material, etc. that can be installed before or after erection. In FIG. 14 thin sheets of such material 26 is easily bent to the curve of the arches and attached to the arches. These sheets can be made stiff enough by reinforcing 27, if necessary, to support exterior equipment 28 and some interior fixtures for lighting 29, sprinklers, etc. The two arches can be structurally bridged 30 to support winches 31, monorail devices or bridge cranes for maintenance and/or repair work on equipment below that is sheltered in the structure. This feature is similar to the one shown in my application S.N. 49811, dated June 25, 1970 entitled, "Pavilion With Intermediate Arch and Method of Assembling and Erecting It."

I claim:

1. A method of constructing a vaulted membrane structure comprising, in combination, a plurality of upright semi-rigid support arches each with curved bights, consecutively spaced apart with their ends mounted on a support means; at least one intermediate support arch interposed between two of said support arches, at least one shallow longitudinal arch, attached to and extending between said two support arches, in perpendicular relationship, as it passes under at least one intermediate support arch to form a vaulted frame in space; a flexible membrane operatively attached to and extending between said upright arches, is tensioned between said arches to form the roof of the structure; said method comprising the following steps:

a. fabricating the roof membrane in sections or as a whole for operatively attachment to said arches,
b. operatively attaching said membrane to said arch members in their flat unbowed state,
c. attaching each end of the shallow longitudinal arch member to a support arch member,
d. bowing the support arch members by moving at least one of their opposite ends toward the other to raise the structure to its erected position,
e. forcing said support arches apart to tension said roof membrane,
f. securing the structure to said support means,
g. installing optional tension members between said arches and said support means or between two points of one arch.

2. The method described in claim 1 wherein said roof membrane is operatively attached to said support arches after step (d) and before step (e).

3. The method described in claim 1 wherein the common ends of the support arch members are attached to a common sub-base means after step (b) but before step (d).

4. The method described in claim 1 wherein said roof membrane is tensioned by adding compression force to said shallow longitudinal arch member and moving the common ends of said support arches apart in step (e).

5. The method described in claim 3 wherein at least one sub-base means is moved towards the other in step (d) and secured to said support means in step (f).

6. The method described in claim 1 wherein the opposite ends of said arch support members are secured to each other by a tension member directly or indirectly through a sub-base means after step (d) and before step (e).

7. The erection method in claim 1 wherein said shallow longitudinal arch is attached to at least one intermediate support arch member, under which it passes, by at least one tension member in step (e).

8. The method described in claim 1 wherein said support arches are forced apart in step (e) by elongating at least one shallow longitudinal arch.

9. The method described in claim 7 wherein said support arches are also forced apart in step (e) by decreasing the length of the tension member between the shallow longitudinal arch and the intermediate support arch.

10. The method described in claim 1 wherein the fabricating of the roof membrane in step (a) includes at least one end closure membrane which is operatively attached to the end support arch after step (f).

11. The method described in claim 2 wherein an end closure membrane is fabricated integrally with the roof membrane in step (a) and tensioned in place in step (f) and readjusted in step (g).

* * * * *